United States Patent [19]

Burke

[11] 4,152,873

[45] May 8, 1979

[54] BONDED TWO PIECE METAL STUD

[75] Inventor: William R. Burke, Tonawanda, N.Y.

[73] Assignee: National Gypsum Company, Dallas, Tex.

[21] Appl. No.: 833,099

[22] Filed: Sep. 14, 1977

[51] Int. Cl.[2] ..... E04H 9/00

[52] U.S. Cl. ..... 52/1; 52/729

[58] Field of Search ..... 52/573, 730, 732, 729, 52/1, 232, 281, 481, 144; 49/DIG. 1

[56] References Cited

U.S. PATENT DOCUMENTS

| | | | |
|---|---|---|---|
| 3,217,659 | 11/1965 | Ford, Jr. | 52/729 UX |
| 3,308,586 | 3/1967 | Olson | 52/144 X |
| 3,402,560 | 9/1968 | Alm | 52/144 X |
| 3,954,067 | 5/1976 | Miles | 52/481 X |
| 3,960,637 | 6/1976 | Ostrow | 52/729 X |
| 4,047,355 | 9/1977 | Knorr | 52/481 X |

FOREIGN PATENT DOCUMENTS

| | | | |
|---|---|---|---|
| 962017 | 4/1957 | Fed. Rep. of Germany | 49/DIG. 1 |

*Primary Examiner*—Price C. Faw, Jr.
*Assistant Examiner*—Carl D. Friedman
*Attorney, Agent, or Firm*—Robert F. Hause

[57] ABSTRACT

Formed sheet metal elongate studs and furring channels with two separate sections bonded together, each section having means for attachment to a wall base or a wall facing material. The sections are bonded together with a heat-sensitive material, preferably a hot-melt adhesive, which melts and separates the sections in a fire, and also tends to reduce thermal conductivity through the stud under conditions that do not melt the adhesive.

5 Claims, 4 Drawing Figures

BONDED TWO PIECE METAL STUD

This invention relates to a modification of the structure of an elongate sheet metal stud for hollow walls wherein the common web portion of the stud is formed of two separate elongate sections which are bonded together to overcome existing problems of heat transfer through the stud, from one side of the wall to the opposite side.

U.S. Pat. No. 2,922,201 discloses a wood stud having opposed elongate portions with an air space interposed therebetween, for reducing sound transmission.

U.S. Pat. No. 3,149,704 discloses the use of fusible elements in a ceiling grid to permit expansion of the metal elements, during fire, without distortion of the grid and the consequent falling out of the ceiling panels.

U.S. Pat. No. 3,125,193 discloses an elongate sheet metal stud for hollow walls having a single metal web extending continuously from one face of the stud to the opposite face.

A problem exists with studs such as in the U.S. Pat. No. 3,125,193 in that heat is readily transmitted from one side of the wall to the opposite side, through the continuous metal web of the stud. If this stud is used in a wall subjected to standard wall fire testing, the wall will fail in the test at a very early time due to the rapid rise in temperature of the side of the stud remote from the fire, due to conduction of heat through the stud web. If this stud is used in freezer wall construction, ambient outside heat will be conducted rapidly through the stud web, warming the interior of the freezer undesirably.

In accordance with the present invention, the stud web is formed of two separate elongate sections, adhered together as along an overlap, with a suitable adherent. The preferred adherent is one which is a poor conductor of heat and which melts or otherwise loses its adherent properties at about 150° C. Such an adherent is an adhesive of the class commonly known as hot-melt adhesives.

If heat conduction under fire conditions is the only concern, a preferred adherent is a low melting temperature solder.

It is an object of the present invention to provide an improved metal wall stud.

It is a further object to provide a steel stud having the ability to minimize heat transfer from one side of the wall to the other side.

It is a still further object to provide an improved fire-resistant hollow shaft wall.

These and other objects and advantages of the invention will be more readily apparent when considered in relation to the preferred embodiment as set forth in the specification and shown in the drawings in which.

Figure 1:
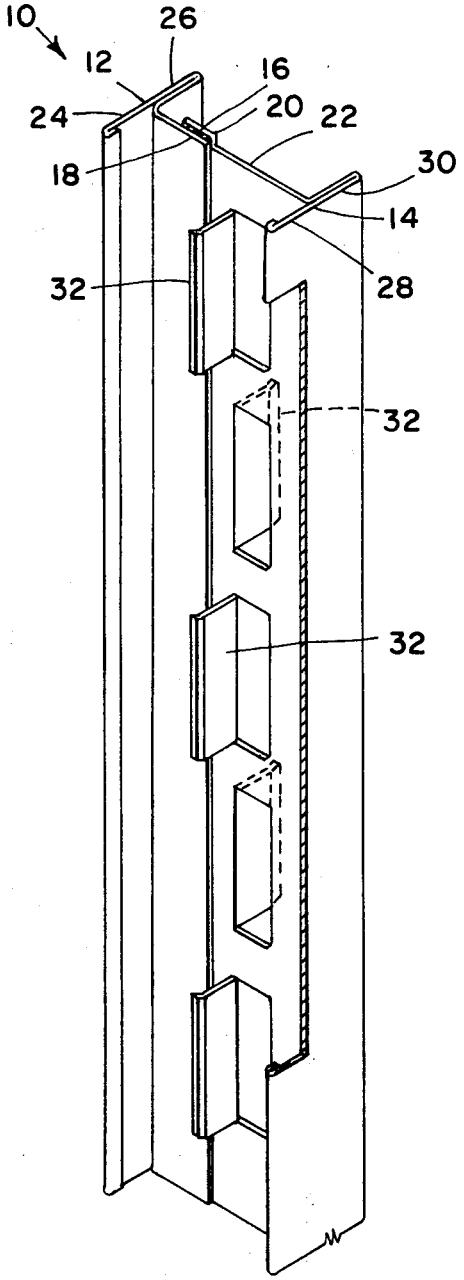
FIG. 1 is an isometric view of a two-section stud embodying the present invention.

Referring to the drawings, FIG. 1 shows a formed sheet metal stud 10, consisting essentially of two elongate -ections, inner section 12 and outer section 14, and an elongate bead of bonding material 16, such as a hot-melt adhesive, bonding together overlapping portions 18 and 20 of sections 12 and 14, respectively.

Stud 10 is formed preferably of 24 gage galvanized sheet steel. The stud 10 includes a central web 22, a pair of elongate oppositely directed flanges 24 and 26, in a plane perpendicular to the general extent of web 22 and along one lateral edge thereof and a second pair of elongate oppositely directed flanges 28 and 30, parallel to flanges 24 and 26 and along the opposite lateral edge of web 22.

In the embodiment of FIG. 1, web 22 has a plurality of tabs 32 cut from and bent out of the plane of the web 22, for holding the edges of boards against the inner side of flanges 28 and 30.

Sections 12 and 14 of stud 10 are joined together in the central web 22, between the tabs 32 and the flanges 24 and 26.

Figure 2:
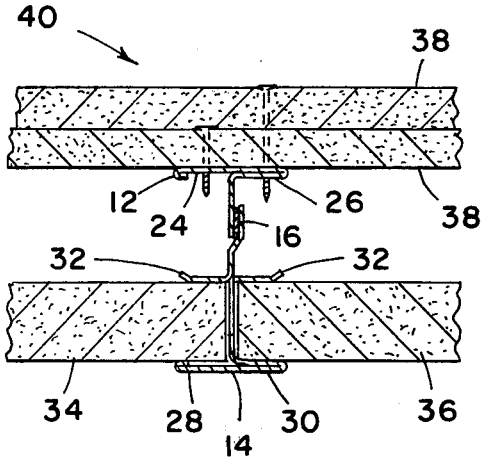
FIG. 2 is a cross-sectional view of a wall constructed embodying the stud of FIG. 1.

FIG. 2 shows gypsum core boards 34 and 36 which have edge portions held between tabs 32 and the inner side of flanges 28 and 30. Gypsum wallboard 38 is screw attached to the outer face of flanges 24 and 26, thus forming a hollow wall 40. Wall 40 may be a hollow shaft wall, for enclosing vertical air shafts such as elevator shafts, with core boards 34 and 36 disposed on the shaft side of the wall.

In case wall 40 is subjected to a fire, on either side, if the stud becomes heated on the fire side, this heat is not conducted through the stud to the opposite side of the wall. Two concepts are involved with the use of hot-melt bonding material 16 joining sections 12 and 14. The hot-melt adhesive is a relatively poor conductor of heat, compared to the continuous metal pathway for heat in prior studs. Secondly, at high temperatures, the hot-melt adhesive will melt, leaving no pathway through the stud to conduct heat from one side of the wall to the other side.

The temperature at which the hot-melt adhesive will melt is determined by the chemical composition of the hot-melt adhesive. An adhesive which melts at about 125° C. to 175° C. is suitable in accordance with the invention, preferably at about 150° C.

The low conductivity of the hot-melt adhesive is advantageous not only in the lower temperature ranges of fire protection, but also in providing improved insulation in very low temperature structures such as freezer walls.

References to hot-melt adhesives herein are intended to mean thermoplastic substances which are composed of a thermoplastic polymeric material and a diluent system. The hot-melt adhesives may be generally defined as 100 percent nonvolatile thermoplastic substances which exist in a solid form at room temperature and which become sufficiently tacky and fluid at elevated temperatures to be employed as adhesives.

The polymer is the essential ingredient in any hot-melt adhesive. Almost any thermoplastic polymeric material with adequate resistance to heat degradation can be suitable for incorporation into a hot-melt adhesive. Examples of film-forming resins which are commonly used for hot-melt adhesives are polyethylene, polyvinyl acetate, ethylene-vinyl acetate copolymers and the like. As the molecular weights of the polymers increase, it may be generally said that the viscosities, strengths, and mechanical properties of the adhesive systems increase.

The diluent system, which is usually a blend of materials such as a wax, a plasticizer, a heat-stabilizer and perhaps dyes, an inert filler or an extender, makes it possible to utilize the properties of the polymer. The diluent functions as the vehicle for the polymer, lowering its viscosity thus making it more convenient to apply as well as enhancing its wetting ability and adhering strength.

In accordance with the invention, other meltable compositions may also be used as bonding material 16, a most common material being solder. Solder does not provide the low temperature insulation function of a hot-melt adhesive, however it does provide for separation of the two elongate sections at preselected high temperatures, caused by fire on one side of the wall. A solder composed of 40% lead, 40% tin and 20% bismuth has a melting, or working temperature of just over 150° C. and is suitable for use in accordance with the invention.

Figure 3:
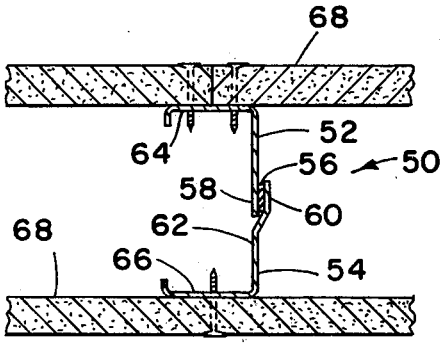
FIG. 3 is a cross-sectional view of a wall having a modified form of stud.

Referring to FIG. 3, a formed sheet metal dry wall screw stud 50 is shown having two elongate sections, inner section 52 and outer section 54, and an elongate bead of heat meltable bonding material 56 bonding together overlapping portions 58 and 60 of sections 52 and 54 respectively.

The two sections 52, 54 are joined in the web 62 of the stud 50, which adjoins the two opposed screw flanges 64, 66. Gypsum wallboard 68 is screw attached to the outer face of each of the flanges 64, 66.

Figure 4:
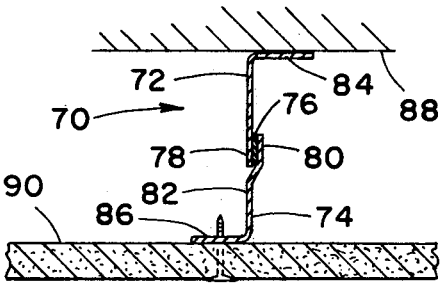
FIG. 4 is a cross-sectional view of a wall having a furring channel constructed in accordance with the invention.

In FIG. 4, a formed sheet metal furring channel 70 is shown having two elongate sections, inner section 72 and outer section 74, and an elongate bead of heat meltable bonding material 76 bonding together overlapping portions 78 and 80 of sections 72 and 74 respectively. The two sections 72, 74 are joined in the web 82 of the furring channel 70, which adjoins two opposed flanges 84, 86. Flange 84 is screw attached to a base such as a concrete wall 88. Gypsum wallboard 90 is screw attached to the outer face of flange 86.

The overlapping portions 18, 20, 58, 60 and 78, 80 of studs 10, 50 and 70 are preferably about 10 mm wide with the heat softenable bonding material disposed substantially completely throughout the area of overlap, in as thin a layer as will provide firm adherence to both overlapping portions of each stud, while preferably preventing any metal to metal contact of the two overlapping portions, particularly when low temperature heat insulation between sections is desired.

Having completed a detailed disclosure of the preferred embodiments of my invention, so that others may practice the same, I contemplate that variations may be made without departing from the essence of the invention.

I claim:

1. A formed, elongate, sheet metal stud having an elongate central web, said web adjoining board supporting means along one elongate web edge with means along the opposite web edge for supporting spaced parallel board for forming a hollow wall, characterized by said stud being formed of two elongate sections which are adhered together in said web along overlapping portions of said two sections, said sections being adhered together by a heat softenable adhesive, wherein said heat softenable adhesive is a hot-melt polymeric adhesive.

2. A stud as defined in claim 1 wherein said two elongate sections have no metal to metal contact.

3. A formed, elongate, sheet metal stud having an elongate central web, said web adjoining board supporting means along one elongate web edge with means along the opposite web edge for supporting spaced parallel board for forming a hollow wall, characterized by said stud being formed of two elongate sections which are adhered together in said web along overlapping portions of said two sections, said sections being adhered together by a heat softenable adhesive, wherein said heat softenable adhesive is solder.

4. A stud as defined in claim 3 wherein said solder consists of a combination of about 40% lead, 40% tin and 20% bismuth.

5. A formed, elongate, sheet metal stud having an elongate central web, said web adjoining board supporting means along one elongate web edge with means along the opposite web edge for supporting spaced parallel board for forming a hollow wall, characterized by said stud being formed of two elongate sections which are adhered together in said web along overlapping portions of said two sections, said sections being adhered together by a heat softenable adhesive, wherein said heat softenable adhesive will release its bond between said overlapping portions when heated to a temperature of at least about 125° C.

* * * * *